United States Patent [19]

Kelley

[11] 4,036,358

[45] July 19, 1977

[54] CLEAR VIEW COIN WRAP

[76] Inventor: Philip Kelley, 32 Leighton St., Pepperell, Mass. 01463

[21] Appl. No.: 738,245

[22] Filed: Nov. 2, 1976

[51] Int. Cl.[2] ..... A45C 11/00

[52] U.S. Cl. ..... 206/.82; 133/1 A; 220/307

[58] Field of Search ..... 133/1 A; 206/.83, .84, 206/.82; 220/82 R, 307; 215/365

[56] References Cited

U.S. PATENT DOCUMENTS

| | | | |
|---|---|---|---|
| 476,309 | 6/1892 | Record | 220/307 |
| 1,407,140 | 2/1922 | Friesen | 133/1 A |
| 2,444,804 | 7/1948 | Carruthers | 133/1 A X |
| 2,977,736 | 4/1961 | Condis | 133/1 A X |
| 3,244,272 | 4/1966 | Beaman et al. | 206/.82 |
| 3,346,109 | 10/1967 | Duran | 206/.82 |
| 3,598,129 | 8/1971 | Itoda | 133/1 A |
| 3,674,295 | 7/1972 | Padovani | 220/307 X |
| 3,877,571 | 4/1975 | Sanford | 206/.83 |

*Primary Examiner*—Robert S. Ward, Jr.

[57] ABSTRACT

A reuseable coin holder for use in removably holding a specific number of coins of a particular diameter within the confines thereof including a cylindrical shell having a closed end defined by a bottom wall and an open end for insertion of the coins therein in stacked relationship, with the open end formed by a frusto-conical section including a tapered wall having an inner surface inclined relative to the shell in order to facilitate the entrance of the coins therein, and closure means operatively associated with the section and adapted to be removably secured thereto and extend thereacross and close off the open end when the coins are stacked therein.

10 Claims, 4 Drawing Figures

CLEAR VIEW COIN WRAP

BACKGROUND OF THE INVENTION

The present invention relates to a reuseable holder for stacking coins in rolls of proper amount.

My invention utilizes a tubular plastic shell of preselected length to stack coins therein of specific amounts. In contrast to prior art devices of this type, my holder is readily reuseable and the closure thereof easily removed to gain access to the coins.

OBJECTS OF THE INVENTION

An object of the present invention is to provide a strong and reliable reuseable coin holder having a closure at one end and means for ejecting the closure when one desires to remove the coins from the holder.

Another object of the present invention is to provide a transparent coin holder with markings thereon and with a closure adapted to readily close the open end of the shell containing the coins.

Other objects and advantages of the present invention will become aparent as the disclosure proceeds.

SUMMARY OF THE INVENTION

A reuseable coin holder for use in removably holding a specific number of coins of a particular diameter within the confines thereof including a cylindrical shell having a closed end defined by a bottom wall and an open end for insertion of the coins therein in stacked relationship, with the open end formed by a frusto-conical section including a tapered wall having an inner surface inclined relative to the shell in order to facilitate the entrance of the coins therein, and closure means operatively associated with the section and adapted to be removably secured thereto and extend thereacross and close off the open end when the coins are stacked therein.

The closure includes an elongated body element having a bottom end and a top end in spaced relationship to each other, with an outer end on each side of the body element tapered to substantially conform to the inner wall of the section. A pair of aligned apertures in the inner wall of the section are provided for use in conjunction with a pair of prongs extending outwardly from each outer end and adapted to snap into the apertures such that the closure is retained in fixed position on the shell with the stacked coins contained therein.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
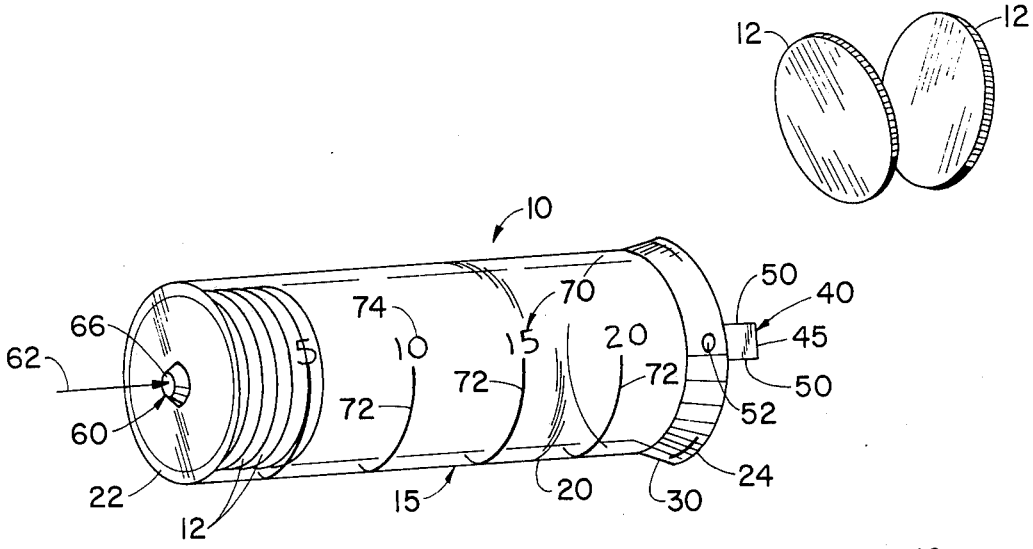
FIG. 1 is a perspective view of the coin holder in accordance with the present invention.

Referring to the drawings there is illustrated in FIGS. 1–4 a reuseable coin holder 10 for use in removably holding a specific number of coins 12 of a particular diameter within the confines thereof. The holder 10 includes a cylindrical shell 15 that may vary in diameter and axial length and has a circular wall 16 having an inner diameter 18 and outer diameter 20. The inner diameter 18 is selected for the particular coins to be contained therein in stacked relationship. The cylindrical shell 15 has a closed end 22 and an open end 24 into which the coins are inserted. The closed end 22 has a bottom wall 25 having an inner surface 26 and outer surface 28.

Figure 4:
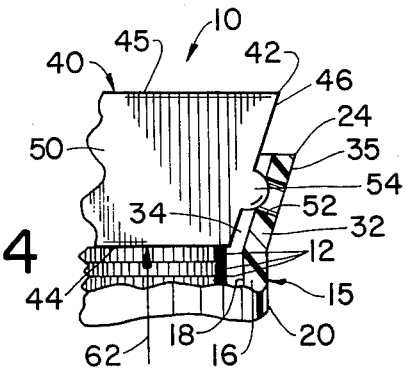
FIG. 4 is a fragmentary enlarged sectional view.
Figure 2:
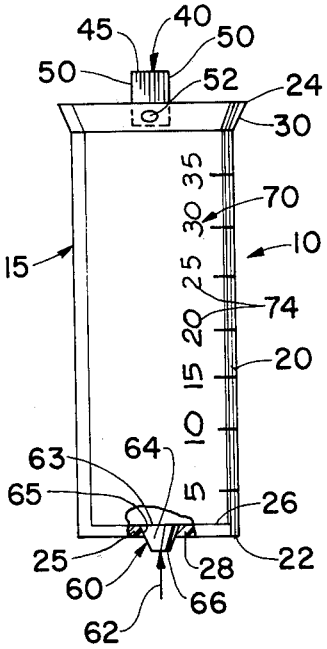
FIG. 2 is a side view of the coin holder, partly in section.
Figure 3:
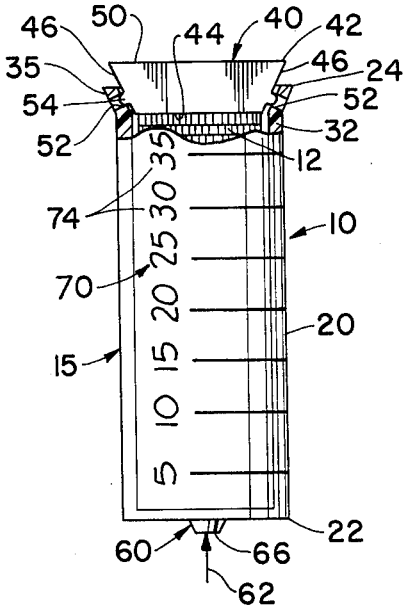
FIG. 3 is an end view of the coin holder, partly in section.

The open end 24 is formed by a frusto-conical section 30 including a tapered wall 32 having an inner surface 34 inclined relative to the inner diameter 18. The outer inclined surface 35 may conform to the shape of the inner inclined surface 34 as illustrated in FIG. 4. By having the shell 15 transparent, the user can view the amount of coins held therein.

Closure means 40 is provided in operatively associated relationship with section 30 and adapted to be removeably secured thereto and extend thereacross and close off the open end 24 of the holder 10 as the coins are stacked therein. The closure means 40 includes an elongated body element, that may be made of plastic or metal, and identified by numeral 42. The body element 42 has a bottom end 44 adapted to abut or engage the uppermost coin 12 in the stack contained in the holder 10. A top end 45 is in spaced relationship to the bottom end 44.

The body element 42 includes an outer end 46 on each side thereof that is tapered to substantially conform to the inclined surface 34 of the section 30. The body element 42 further includes planar side surfaces 50. The thickness between the side surfaces 50 is selected to permit the user to readily grasp same for insertion into section 30. Section 30 includes a pair of aligned apertures 52 which are provided to receive a pair of prongs 54 extending outwardly from each outer end 46. The prongs 54 snap into the apertures 52 such that the closure 40 is retained in fixed position on the shell 15 to retain the stack of coins 12 therein. Each prong 54 has a rounded configuration to facilitate the insertion and removal from a respective aperture 52.

To facilitate the removal of the closure 40 from the shell 15 when a full set of coins 12 are contained therein, ejecting means 60 is provided. The ejecting means 60 is so designed such that when a force in the direction of single headed arrow 62 is applied, the force will be transmitted through the coins 12 and outwardly force the closure 40 from its seated position. The ejecting means 60 is associated with the bottom wall 25 and the release force is transmitted through release element 64 mounted in an aperture 65 on the bottom wall 25. The release element has a distal end 66 extending beyond the closed end 22 and an inner end 68 contained within the shell 15. The element 64 is adapted to move vertically within the shell such that when a force is applied it is transmitted through the coins 12. The force transmitted by the body element 64 is sufficient to pop or release the prongs 54 from the apertures 52 to thereby free the closure 40 from the shell 15 for removal of the coins 12.

To retain the release element 64 in place, the opening 65 is conical such that the inner end 68 is of larger cross-sectional area than the distal end 66. In this manner the element 64 may move freely when the force of arrow 62 is applied. The force may be applied manually or by a quick downward movement on a table or other surface.

To indicate to the user the amount of coins therein, indicia means 70 is provided and may include the cumulative sum of the coins 12 stacked therein as well as having horizontal lines 72 and numerals 74 of various amounts.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A reuseable coin holder for use in removably holding a specific number of coins of a particular diameter within the confines thereof including:

a. a cylindrical shell having a closed end defined by a bottom wall and an open end for insertion of the coins therein in stacked relationship, b. said open end formed by a frusto-conical section including a tapered wall having an inner surface inclined relative to said shell in order to facilitate the entrance of the coins therein, c. closure means operatively associated with said section and adapted to be removably secured thereto and extend thereacross and close off said open end when the coins are stacked therein, said closure including:

1. an elongated body element having a bottom end and a top end in spaced relationship to each other,
2. an outer end on each side of said body element tapered to substantially conform to said inner wall of said section,
3. a pair of aligned apertures in said inner wall of said section, and
4. a pair of prongs extending outwardly from each said outer end and adapted to snap into said apertures such that said closure is retained in fixed position on said shell with the stacked coins contained therein.

2. A reuseable coin holder as in claim 1, and further including ejecting means operatively associated with said bottom wall of said shell to release said closure utilizing the stack of coins in said shell for transmitting the release force required.

3. A reuseable coin holder as in claim 2, wherein said ejecting means includes:

a. a release element mounted on said bottom wall having a distal end extending beyond said shell when the holder contains a full stack of coins and an inner end contained within said shell, and b. said element adapted to move vertically within the shell such that when a force is applied to said distal end when a full stack of coins are contained therein a force is applied through the stack of coins to said bottom end of said body element so as to release said prongs from within said apertures and thereby free said closure from said shell for removal of the coins therefrom.

4. A reuseable coin holder as in claim 3, wherein said ejecting means includes:

a. a conical opening in said bottom wall for receiving said release element seated therein, and b. said inner end being of larger cross-sectional area than said distal end to remain contained in said shell.

5. A reuseable coin holder as in claim 4, wherein said release element may move freely in said aperture.

6. A reuseable coin holder as in claim 1, wherein said body element has planar side surfaces.

7. A reuseable coin holder as in claim 1, wherein said prongs have a rounded configuration to facilitate insertion within said apertures.

8. A reuseable coin holder as in claim 1, wherein said shell is transparent.

9. A reuseable coin holder as in claim 1, and further including indicia means on said shell to indicate the cumulative sum of the coins stacked therein.

10. A reuseable coin holder as in claim 9, wherein said indicia means includes horizontal lines and numerals.

* * * * *